US005523804A

United States Patent [19]

Nolan

[11] Patent Number: 5,523,804

[45] Date of Patent: Jun. 4, 1996

[54] LENS SYSTEM FOR DIVER'S MASK

[76] Inventor: Philip Nolan, 133 S. Scoville St., Oak Park, Ill. 60302

[21] Appl. No.: 461,262

[22] Filed: Jun. 5, 1995

Related U.S. Application Data

[60] Continuation-in-part of Ser. No. 324,724, Oct. 18, 1994, abandoned, which is a division of Ser. No. 842,428, Feb. 27, 1992, Pat. No. 5,359,371, which is a continuation-in-part of Ser. No. 518,184, May 3, 1990, abandoned.

[51] Int. Cl.[6] ..... G02C 1/00

[52] U.S. Cl. ..... 351/43; 351/41

[58] Field of Search ..... 351/43, 41, 158; 2/441, 442, 445, 446, 447, 14

[56] References Cited

U.S. PATENT DOCUMENTS 3,051,957 9/1962 Chan ..... 351/43

*Primary Examiner*—William L. Sikes
*Assistant Examiner*—Hung Xuan Dang
*Attorney, Agent, or Firm*—Godfrey & Kahn

[57] ABSTRACT

An underwater diving mask, including a preformed face piece of suitable material so as to yieldably fit the contour of a wearer's face, and a strap for holding the face piece against the wearer's face. The mask has at least one large opening formed in the forward part thereof, and a rigid plate-like supporting structure carried by the face piece closing the opening. In one embodiment a pair of reducing, single sided concave lenses, one for each eye of the user, are formed in side-by-side relationship in the supporting structure. In another embodiment there is a single plate which is itself a single reducing lens. In yet another embodiment two openings and two lenses are provided, each a reducing lens. So as to properly compensate for the foreshortening effect of the water, the reducing power of the lens system is between zero and −0.50. The supporting member and lenses are prepared directly or treated or coated, such as by dipping, with a coloring agent. This is to inhibit passage through the lenses of certain wavelengths of light in order to correct the color distortion inherent in underwater viewing, and/or to provide protection from dangerous radiations.

12 Claims, 2 Drawing Sheets

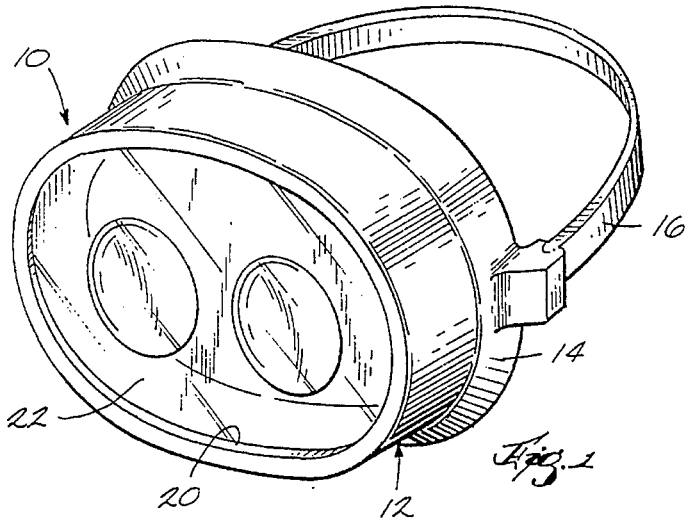
Fig. 1
Fig. 2.
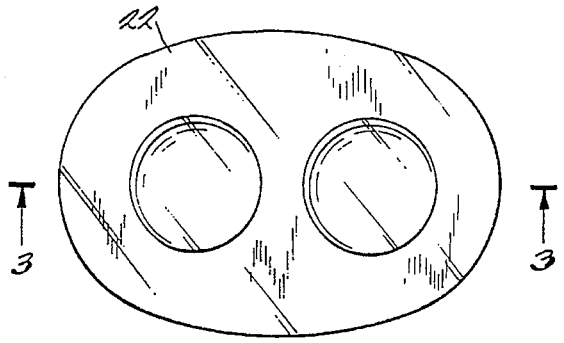
Fig. 3
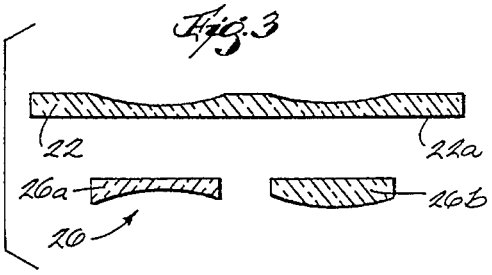
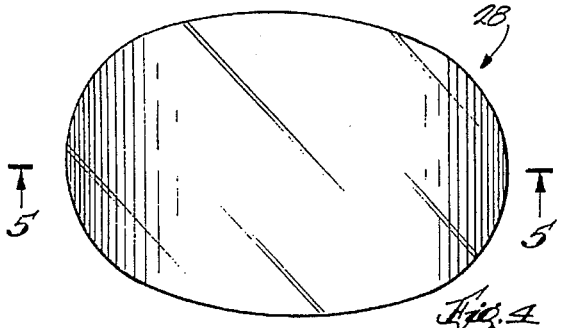
Fig. 4
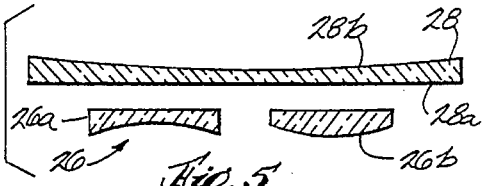
Fig. 5

LENS SYSTEM FOR DIVER'S MASK

CROSS-REFERENCES TO RELATED APPLICATIONS

This application is a continuation-in-part of my prior application Ser. No. 08/324,724, filed Oct. 18, 1994, now abandoned, which was a divisional of Ser. No. 07/842,428, filed Feb. 27, 1992, now U.S. Pat. No. 5,359,371, issued Oct. 25, 1994, which was in turn a continuation-in-part of Ser. No. 07/518,184, filed May 3, 1990, now abandoned.

BACKGROUND OF THE INVENTION

This invention relates to lens systems for use in connection with providing vision through media having different indices of refraction, and in particular to lens or mask systems for use in diving and providing vision under water.

While underwater face masks have been in use for some time, nevertheless entirely satisfactory results have not been obtained. Most commonly, divers use a face mask merely to keep the water away from the eyes. Such a mask has generally included a flexible face piece, preshaped to fit closely against the face of the wearer, positioned in front of the eyes, and usually also over the nose. One or more relatively large flat disk-like plates of transparent plastic or the like were held in a sight opening in the face piece to serve as a window therein. By this means the eyes are allowed to focus under the water, which they could not do as easily were it not for the mask. Because water has a higher refractory index than air, however, a foreshortening effect occurs, making underwater objects appear closer and larger than they really are.

The problem of this foreshortening effect has been attacked in the past by making the lens system more complex, such as that shown in Simpson, U.S. Pat. No. 3,040,616. That patent shows a multiple lens system wherein water is permitted to enter behind a part of the system when the user is underwater. The purpose of this arrangement is to permit the user to see equally well when out of the water as when in. Since the diver usually takes his mask off when out of the water, however, such a structure is much more complex, and hence expensive, than necessary.

In using a mask described in another patent, Hagen, U.S. Pat. No. 3,672,750, a diver is required to look through several layers of material, necessarily having a refractive boundary between them. Further, the mask described in that patent provides convex lenses, which tend to invert the image being seen. And that mask does nothing to correct the color distortion inherent in underwater viewing. Correspondingly the Hagen patent also does not in any way mention the safety advantages of protecting workers from underwater ionizing and non-ionizing emissions.

This invention relates to improvements to the structure indicated above and to solutions to the problems raised or not solved thereby.

SUMMARY OF THE INVENTION

The invention relates to an underwater diving mask. In a preferred embodiment the mask includes a preformed face piece of suitable material so as to yieldably fit the contour of a wearer's face, and means for holding the face piece against the wearer's face. The mask has one or more large openings formed in the forward part thereof, and a rigid plate-like supporting structure carried by the face piece closing each opening. In one embodiment the supporting plate constitutes a single lens, having a flat surface toward the diver's face and a slightly concave surface away from the diver's face, thus forming a single large reducing lens. In another embodiment, the plate itself is substantially flat on both sides, and a pair of concave depressions are formed in the side of the plate facing away from the diver's face. These depressions form reducing lenses, one for each eye of the user. In yet another embodiment two separate plates are provided, in side by side relationship, one for each eye of the user. So as to properly compensate for the foreshortening effect of the water, the reducing power of the lens system is preferably functionally non-corrective, that is, between zero and −0.50, and preferably between zero and −0.20. These values achieve the desired compensation for the foreshortening effect, while remaining well out of range of diopters used for corrective vision. Means may be applied to the lenses, or to the plate itself, to inhibit passage therethrough of certain wavelengths of light. These inhibiting means are effective to correct the color distortion inherent in underwater viewing, and to protect the diver from ionizing and non-ionizing radiation emissions associated with dangerous underwater work such as gas and arc welding operations.

Other objects and advantages of the invention will become apparent hereinafter.

DESCRIPTION OF THE DRAWING

FIG. 1 is an isometric view of a diving mask constructed according to one embodiment of the invention.

FIG. 2 is a front view of a supporting plate to be used in the diving mask shown in FIG. 1.

FIG. 3 is a cross-sectional view of the supporting plate shown in FIG. 2, taken generally along line 3—3.

FIG. 4 is a front view of a supporting plate to be used in the diving mask shown in FIG. 1, according to an alternative embodiment of the invention.

FIG. 5 is a cross-sectional view of the supporting plate shown in FIG. 4, taken generally along line 5—5.

DESCRIPTION OF THE PREFERRED EMBODIMENTS

Figure 6:
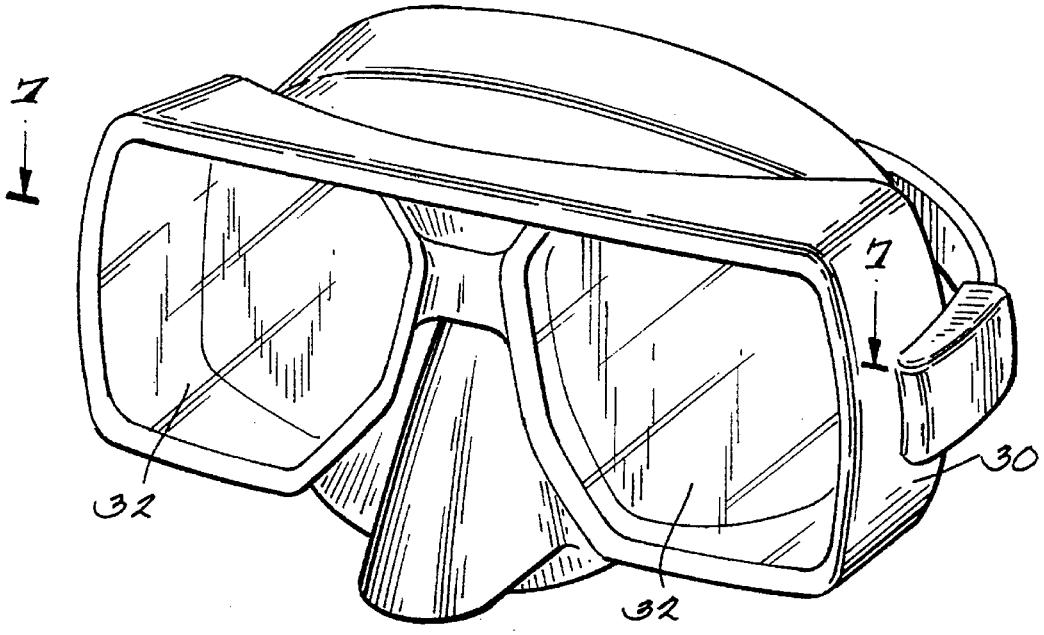
FIG. 6 is an isometric view of a diving mask constructed according to yet another embodiment of the invention.

Referring now to FIG. 1, there is shown a diver's mask 10 constructed according to one embodiment of the invention. As there shown, the mask 10 includes a face piece 12, the back portion 14 of which is of a relatively soft material, and is formed so as to yieldably fit the shape of a diver's face in the area of his nose and eyes, to as much as possible seal out water. Means are provided for holding the face piece 12 against the diver's face. Conventionally a strap 16 is provided, each end of which is connected to the face piece 12, at the back portion 14, by attachment means 18. The material of the strap 16 is normally elastic in nature, so as to provide a snug fit of the back portion 14 against the diver's face and seal out water. The length of the strap 16 may also be adjustable for the same purpose.

A large rounded opening 20 is formed at the front of the face piece 12, making the face piece roughly cylindrical in shape. A plate-like structure 22 is affixed within this opening 20, closing it. In the embodiment shown in FIGS. 2 and 3 this structure 22 is a transparent member which is substantially flat and rigid. While the structure 22 is shown in FIG.

2 to have an elliptical shape, the invention includes any shape suitable for use in or adaptation to existing, conventional diver's masks. According to this embodiment of the invention the structure 22 has formed therein a pair of concave areas, constituting lenses 24, in side-by-side relation, one lens for each eye of the diver. To counteract the foreshortening effect referred to above, the lenses 24 must have a reducing power which should be between zero and −0.50, and preferably between zero and −0.20. That is, objects viewed through the lenses in air would appear about 95% to 98% as large as they would without the lenses.

Figure 7:
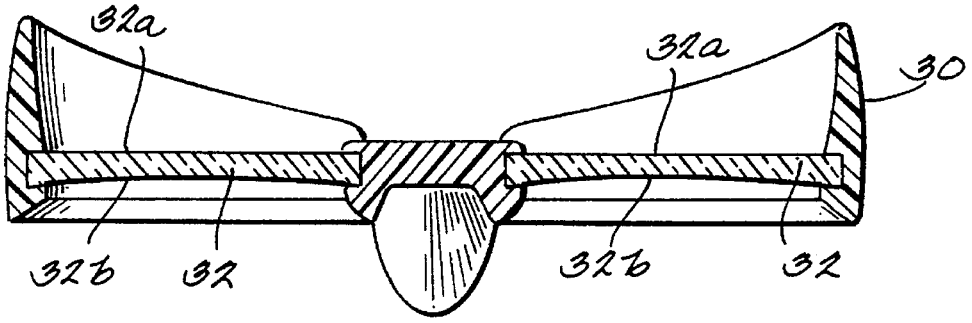
FIG. 7 is a cross-sectional view of the mask shown in FIG. 6, taken generally along line 7—7.

A face plate constructed according to another embodiment of the invention is shown in FIGS. 4 and 5. In this embodiment a single face plate 28 may be used in a diving mask with a single opening face piece 12, as shown in FIG. 1, or in a diving helmet (not shown). In the embodiment shown in FIGS. 4 and 5, the face plate 28 of this embodiment is a single reducing lens, with a rear surface 28*a*, facing toward the diver's face, that is substantially flat, and a front surface 28*b*, facing away from the diver's face, that is slightly concave. The embodiment shown in FIGS. 6 and 7 includes a face piece 30 having separate lenses 32 for each of the diver's eyes. Here again, the rear surface 32*a*, facing toward the diver's face, is substantially flat, and the front surface 32*b*, facing away from the diver's face, is slightly concave. In both of these embodiments, the reducing effect is not sufficient to require the plate 28 or lenses 32 to be considered a corrective lens. For example, assuming the longest dimension of the plate 28 or lens 32 is 125 to 180 mm, the plate or lens may be 4 mm thick at the edges and 3.95 mm thick in the center. Again, as stated above with respect to lenses 24, plate 28 and lenses 32 must have a reducing power which should be between zero and −0.50, and preferably between zero and −0.20. That is, objects viewed through the plate 28 or lenses 32 in air would appear about 95% to 98% as large as they would without the plate.

In the embodiment shown in FIGS. 2 and 3, each lens 24 is integrally formed with the supporting member 22. In the embodiments shown in FIGS. 4 through 7, the plate 28 or each lens 32 itself constitutes a single reducing lens. In each embodiment, the material of the supporting member 22, plate 28 and lenses 32 should be optical quality material, such as optical quality polycarbonate, obtainable from General Electric under the trademark LEXAN. From FIGS. 3, 5 and 7 it can be seen that the concave surface of lenses 24, plate 28 or lenses 32 is structurally different from conventional flat mask plates. Flat mask plates are characterized by having as a property a critical angle and lose a significant amount of incident light to total reflection. Lenses 24, plate 28 and lenses 32 have no such critical angle. The structures provided by the present invention gather more light, and objects viewed by divers appear brighter, and are seen at a greater distance.

One problem commonly encountered by divers is the color distortion caused by the filtering of light by upper levels of the water. Most commonly, a diver will see more blue or green underwater than in sunlight. True color perception can be important to divers, particularly if they are involved in photographic activities, in welding, burning or cutting activities, or other activities requiring true color perception. In addition, in certain activities the diver needs protection from ionizing and non-ionizing radiation emissions associated with dangerous underwater work such as gas and arc welding operations. To reduce color distortion and emissions, the supporting member 22, plate 28 or lenses 32, may be treated, such as by dipping, with a coloring agent. The coating should have high mar resistance and not be easily scratched. One such agent the applicant has found to work well with the polycarbonate material of the supporting member 22, plate 28 or lenses 32 is a material available from Morton International of Lansing, Mich., referred as LS-123. If a yellow color coating is applied, the coating will serve to absorb the blue spectrum at depth and restore a diver's perception of natural color. Alternatively the support 22, plate 28 or lenses 32 may be formed with material that is already colored as desired. Such direct preparation may be less expensive. General Electric does have suitable material available in colors necessary to protect divers from the dangers of ionizing and non-ionizing radiation emissions, such as those encountered by underwater welders.

As indicated above, the surface 22*a* of the supporting member 22, the surface 28*a* of plate 28, and the surface 32*a* of lenses 32, each facing toward the diver's face, are substantially flat. These flat surfaces 22*a*, 28*a*, 32*a* permit the application of corrective lenses 26 by the diver. A pair of lenses similar to concave lens 26*a* (FIGS. 3 and 5) would be used for a diver who is nearsighted, while a pair of lenses similar to convex lens 26*b* (FIGS. 3 and 5) would be used for a diver who is farsighted. This feature permits the diver who requires corrective lenses to take equal advantage of the invention.

Such a system would be quite straightforward in manufacture, and thus quite inexpensive. Thus the invention provides for a diver's mask, or a replacement plate, which compensates for the foreshortening effect of the water while causing substantially no distortion in air. A mask or helmet plate constructed according to the invention provides a brighter object image underwater, and extends the limits of underwater visibility. In addition, such a mask or plate compensates for the color distortion of the water, and yet is simple and inexpensive to manufacture. The efficiency and safety of a diver using such a mask or plate in the underwater workplace is thus improved.

While the apparatus hereinbefore described is effectively adapted to fulfill the aforesaid objects, it is to be understood that the invention is not intended to be limited to the specific preferred embodiment of diver's mask set forth above. Rather, it is to be taken as including all reasonable equivalents within the scope of the following claims.

I claim:

1. An underwater diving mask comprising:

a preformed face piece of suitable material so as to yieldably fit the contour of a wearer's face and having a single large opening formed in the forward part thereof so that the face piece fits over at least both eyes of the wearer;

means for holding said face piece against the wearer's face;

a single lens installable into said face piece, said lens having a substantially flat surface facing toward the wearer's face and a slightly concave surface facing away from the wearer's face.

2. An underwater diving mask as recited in claim 1 further comprising means applied to said lens to inhibit passage therethrough of certain wavelengths of light.

3. An underwater diving mask as recited in claim 1 further comprising means for affixing corrective lenses to said substantially flat side of said lens, to correct the vision of a wearer who would normally need corrective lenses.

4. An underwater diving mask as recited in claim 1 wherein said lens has reducing power of between zero and −0.20.

5. An underwater diving mask comprising:

a preformed face piece of suitable material so as to yieldably fit the contour of a wearer's face and having at least one opening formed in the forward part thereof, the face piece fitting over at least both eyes of the wearer;

means for holding said face piece against the wearer's face;

at least one lens installable into said face piece, said lens having a substantially flat surface facing toward the wearer's face and a slightly concave surface facing away from the wearer's face.

6. An underwater diving mask as recited in claim 5 further comprising means applied to said lens to inhibit passage therethrough of certain wavelengths of light.

7. An underwater diving mask as recited in claim 5 further comprising means for affixing corrective lenses to said substantially flat side of said lens, to correct the vision of a wearer who would normally need corrective lenses.

8. An underwater diving mask as recited in claim 5 wherein said lens has reducing power of between zero and –0.20.

9. An underwater diving mask comprising:

a preformed face piece of suitable material so as to yieldably fit the contour of a wearer's face and having a pair of openings formed in the forward part thereof, the face piece fitting over at least both eyes of the wearer;

means for holding said face piece against the wearer's face;

a single lens installable into each opening of said face piece, each said lens having a substantially flat surface facing toward the wearer's face and a slightly concave surface facing away from the wearer's face.

10. An underwater diving mask as recited in claim 9 further comprising means applied to said lenses to inhibit passage therethrough of certain wavelengths of light.

11. An underwater diving mask as recited in claim 9 further comprising means for affixing corrective lenses to said substantially flat side of said lenses, to correct the vision of a wearer who would normally need corrective lenses.

12. An underwater diving mask as recited in claim 9 wherein said lenses have reducing power of between zero and –0.20.

* * * * *